US006168422B1

(12) United States Patent
Motyka et al.

(10) Patent No.: US 6,168,422 B1
(45) Date of Patent: Jan. 2, 2001

(54) GAS INCINERATOR

(75) Inventors: Daniel R. Motyka; John K. S. Loh, both of Calgary (CA)

(73) Assignee: Questor Technology, Inc., Calgary (CA)

( * ) Notice: Under 35 U.S.C. 154(b), the term of this patent shall be extended for 0 days.

(21) Appl. No.: 09/433,529

(22) Filed: Nov. 3, 1999

(51) Int. Cl.[7] ..... F23D 13/20

(52) U.S. Cl. ..... 431/202; 431/5; 431/186; 431/354

(58) Field of Search ..... 431/202, 5, 186, 431/350, 354, 183

(56) References Cited

U.S. PATENT DOCUMENTS

| | | | | |
|---|---|---|---|---|
| 4,140,471 | * | 2/1979 | Straitz, III et al. | 431/202 |
| 4,245,980 | | 1/1981 | Reed et al. . | |
| 4,392,817 | * | 7/1983 | Berlie et al. | 431/202 |
| 4,431,403 | | 2/1984 | Nowark et al. . | |

FOREIGN PATENT DOCUMENTS

| | | | | |
|---|---|---|---|---|
| 1301048 | | 5/1992 | (CA) . | |
| 2168807 | | 6/1997 | (CA) . | |
| 2105394 | * | 4/1972 | (FR) | 431/202 |

* cited by examiner

*Primary Examiner*—James C. Yeung
(74) *Attorney, Agent, or Firm*—Renner, Kenner, Greive, Bobak, Taylor & Weber

(57) ABSTRACT

There is provided a gas incinerator having a combustion chamber above a lower chamber and communicating therewith. Combustion air flows into the lower chamber, thence upwardly toward the combustion chamber. Vanes are provided in the lower chamber, to impart a rotational movement to the air as it rises toward the combustion chamber. Nozzles are located toward the bottom of the combustion chamber for injecting the fuel, in the form of gas, into the combustion chamber so as to cause the injected gas to rotate oppositely to the air rotation, in order to provide substantial turbulence and mixing. The injection direction of the gas also lies substantially parallel with a hypothetical plane transverse to the axis of the cyclonic movement of air, thus avoiding an axial component in the injection direction of the gas, and therefore minimizing the expulsion of gas, air and combustion products from the combustion chamber.

15 Claims, 7 Drawing Sheets

GAS INCINERATOR

This invention relates generally to incinerators for burning gas in such a way as to achieve complete combustion without visible flames at the outlet for the combustion gases.

BACKGROUND OF THIS INVENTION

In the field involving the combustion of gaseous products, two distinct constructions can be identified.

The first is that of a conventional burner, of the kind used in boilers, furnaces and the like. The second is properly referred to as an incinerator, or "waste gas incinerators", where the object is to bum off undesirable gases, for example gases with a substantial content of sulphuric or nitrogen compounds.

The aim in constructing a burner (the first category) is to produce a long and efficient flame which is projected out of the burner toward the surfaces intended to receive the heat from the flame (like water-tubes in a boiler). By contrast, it is desirable to construct an incinerator in such a way that all visible flame is retained within the incinerator, and the gaseous products of combustion escape from the incinerator invisibly.

There is a need in the industry for a gas incinerator suitable for waste and other gases, which eliminates visible flame and which creates a stable internal fireball which is continuously fed with waste gas and air, and wherein the dynamics of the structure allow for the air to be drawn into the combustion area by natural convection, without having to supply a source of pressurized combustion air.

PRIOR ART

Typical of the prior art relating to burners is U.S. Pat. No. 4,245,980, issued Jan. 20, 1981 to Reed et al. In the Reed device, a nozzle connected to a source of fuel is adapted to spray the fuel in a conical configuration into a combustion chamber. The fuel, having been ignited, then is expelled from the combustion chamber. As this device is a burner, rather than an incinerator, the main aim is to ensure that most of the gaseous fuel will be burned outside the burner, since the components or surfaces intended to receive the heat are generally located a certain distance away from the burner.

Another patent directed to a burner is U.S. Pat. No. 4,431,403, issued Feb. 14, 1984, to Nowak et al. In this patent, primary air is mixed with a gaseous fuel and is sprayed divergingly-into a combustion chamber. Secondary air is provided under pressure, and undergoes a division into two pathways. The result is that one portion of the secondary air rotates in a first cyclonic direction, and the other portion of the secondary air rotates in the opposite sense. These two fractions of the secondary air commingle, and this is said to promote good mixing of the secondary air with the fuel/primary air. Here again, the point is to merely initiate burning in the combustion chamber, and to produce a long flame reaching away from the burner, providing heat to various surfaces.

Canadian patent 1,301,048, issued May 19, 1992 to Bob Polak is also of interest. This device is entitled "Acid Gas Burner", and the patentee states that his invention is particularly directed toward acid gas burners utilized in sulphur plant waste heat boilers. In order to function properly in a boiler, the burners will have to produce a flame front adapted to provide heat to distant surfaces. In this patent, there is a particular indication that the burner is in fact a burner, rather than a device intended to contain a fireball without any visible flames leaving the apparatus. This is found in FIG. 1, where gas feed pipes communicate with the combustion chamber in such a way as to produce two kinds of motion: a rotary or cyclonic motion, in which the fuel rotates about a central axis, and a forward sloping component, which gives the fuel a thrust toward the open end of the combustion location, thus in effect "pushing" the fuel in the direction of the opening. If this construction were used for an incinerator, the forward slope of the gas-delivery tubes would force the flame front out of the apparatus in the manner common to all burners.

In this prior patent, there is also the provision of a vane arrangement which swirls a portion of the combustion air as it enters an upstream opening. However the vane arrangement covers only the peripheral portion of the airconveying duct, leaving a central core relatively unaffected. This diminishes the degree of turbulence that can be attained in the device of Polak.

Also of interest is Canadian published application 2,168,807, Jones, issued Feb. 5, 1996 for a "Gas Flare". In this application, a gas flare is described as including a vent stack for combustion air with a first end and a second end. A gaseous fuel cyclone chamber surrounds the vent stack. The cyclone chamber has an interior wall in common with the vent stock, and an exterior wall spaced around the vent stack. The cyclone chamber narrows to define an access opening adjacent the first end of the vent stack. A fuel injection ring surrounds the first end of the vent stack with fuel nozzles extending into the access opening of the cyclone chamber. Gaseous fuel feeds into the cyclone chamber and is thoroughly mixed prior to combustion. Ignition means is positioned above the first end of the stack. Gaseous fuel flowing under pressure from the cyclone chamber creates a venturi effect, drawing air up the vent stack to form a mixture of air and fuel, which is ignited by the ignition means. Combustion air passes along a passageway which communicates with a second end of the vent stack. The combustion air passage follows a circuitous route, including the exterior wall of the cyclone chamber, whereby combustion air in the air passage draws heat from the cyclone chamber.

GENERAL DESCRIPTION OF THIS INVENTION

This invention is specifically directed to a gas incinerator adapted to create and maintain a fireball in such a way as to avoid having flames within the combustion gases where they leave the device.

More particularly, there is provided a gas incinerator having a combustion chamber above a lower chamber and communicating therewith. Combustion air is able to flow into the lower chamber and thence upwardly toward the combustion chamber. Vanes are provided in the lower chamber, configured so as impart a rotational movement to air moving upwardly toward the combustion chamber. Nozzles are provided for injecting a gaseous fuel into the combustion chamber in such a way as to cause the injected gas to rotate oppositely to the air rotation, in order to provide substantial turbulence and mixing. The injection direction of the waste gas lies substantially parallel with a hypothetical plane transverse to the axis of the cyclonic movement of air, thus avoiding an axial component in the injection direction of the gas, and therefore minimizing the expulsion of gas, air and combustion products from the combustion chamber. An ignition modality is provided for igniting the mixture of gas and combustion air.

Still more particularly, this invention provides a gas incinerator comprising:

a base portion having lower wall means defining a lower chamber, aperture means in the lower wall means, through which combustion air can flow from outside the incinerator into the lower chamber, an upper portion having upper wall means defining a combustion chamber in communication with said lower chamber, the combustion chamber having, remote from the lower chamber, an opening through which products of combustion can exit from the combustion chamber, vane means within said lower chamber, the vane means being configured so as to impart a cyclonic movement in one rotary direction to air moving upwardly from the lower chamber to the combustion chamber, nozzle means for injecting gas into the combustion chamber in such a direction as to impart, to the injected gas, a cyclonic movement in the rotary direction opposite to said one rotary direction, while avoiding promotion of gas movement out through said opening, and ignition means for igniting a mixture of gas and combustion air in the combustion chamber, thereby causing combustion air to be drawn into the lower chamber and thence to pass upwardly into the combustion chamber to mix with the gas, the vane means imparting said cyclonic movement in one rotary direction to the upwardly moving air while the nozzle means creates in the injected gas the said cyclonic movement in the opposite rotary direction, resulting in a thorough mixing of the air with the gas.

Further, this invention provides a process for incinerating gas, utilizing a gas incinerator which includes: a base portion having lower wall means defining a lower chamber; aperture means in the lower wall means, through which combustion air can flow from outside the incinerator into the lower chamber; an upper portion having upper wall means defining a combustion chamber in communication with said lower chamber, the combustion chamber having, remote from the lower chamber, an opening through which products of combustion can exit from the combustion chamber; vane means within said lower chamber, the vane means being configured so as to impart a cyclonic movement in one rotary direction to substantially all of the air moving upwardly within the lower chamber; nozzle means for injecting gas into the combustion chamber in such a direction as to impart, to the injected gas, a cyclonic movement in the rotary direction opposite to said one rotary direction, while avoiding the promotion of gas movement out through said opening; and ignition means for igniting a mixture of gas and combustion air in the combustion chamber, the process comprising the steps:

a) injecting gas into the combustion chamber, b) causing combustion air to be drawn into the lower chamber and thence to pass upwardly into the combustion chamber to mix with the gas, c) igniting the mixture of gas and combustion air d) utilizing the vane means to impart the said cyclonic movement in one rotary direction to substantially all of the upwardly moving air, and e) utilizing the nozzle means to create in the injected gas the said cyclonic movement in the opposite rotary direction, resulting in a thorough mixing of the air with the gas, and the creation of a substantially stationary, stable, tight fireball in the vicinity of the nozzle means, thus ensuring that flame production will take place substantially entirely within the combustion chamber and that a visible flare will be avoided.

Further, this invention provides a process for incinerating gas, comprising the steps, drawing combustion air into a lower chamber;

causing the air to rise through the lower chamber and enter a combustion chamber located thereabove, imparting to the air a cyclonic movement in one rotary direction as it rises in the lower chamber, in the combustion chamber, injecting gas substantially in a direction parallel to a plane transverse to the axis of the cyclonic air movement, and substantially tangentially so as to create a gas vortex rotating oppositely to said one rotary direction, allowing the air and gas to impinge upon one another in order to attain thorough mixing, and igniting the resultant mixture in the combustion chamber.

Further, this invention provides A gas incinerator comprising:

a base portion having lower wall means defining a lower chamber, aperture means in the lower wall means, through which combustion air can flow from outside the incinerator into the lower chamber, an upper portion having upper wall means defining a combustion chamber in communication with said lower chamber, the combustion chamber having, remote from the lower chamber, an opening through which products of combustion can exit from the combustion chamber, vane means within said lower chamber, the vane means being configured so as to impart a cyclonic movement in one rotary direction to air moving upwardly from the lower chamber to the combustion chamber, nozzle means for injecting gas into the combustion chamber in such a direction as to impart, to the injected gas, a cyclonic movement in the rotary direction opposite to said one rotary direction, the injection direction of substantially all of the gas being substantially parallel with a hypothetical plane transverse to the axis of the said cyclonic movement of air, thereby to avoid an axial component in the injection direction of the gas, and thus minimize the expulsion of gas, air and combustion products from the combustion chamber, and ignition means for igniting a mixture of gas and combustion air in the combustion chamber, thereby causing combustion air to be drawn into the lower chamber and thence to pass upwardly into the combustion chamber to mix with the gas, the vane means imparting said cyclonic movement in one rotary direction to the upwardly moving air while the nozzle means creates in the injected gas the said cyclonic movement in the opposite rotary direction, resulting in a thorough mixing. of the air with the gas.

Finally, this invention provides a process for incinerating a gas, utilizing a gas incinerator which includes: a base portion having lower wall means defining a lower chamber; aperture means in the lower wall means, through which combustion air can flow from outside the incinerator into the lower chamber; an upper portion having upper wall means defining a combustion chamber in communication with said lower chamber, the combustion chamber having, remote from the lower chamber, an opening through which products of combustion can exit from the combustion chamber; vane means within said lower chamber, the vane means being configured so as to impart a cyclonic movement in one rotary direction to substantially all of the air moving upwardly within the lower chamber; nozzle means for injecting gas into the combustion chamber in such a direction as to impart, to the injected gas, a cyclonic movement in the rotary direction opposite to said one direction, the injection direction of substantially all of the gas being substantially parallel with a hypothetical plane transverse to the axis of the said cyclonic movement of air, thereby substantially to avoid an axial component in the injection direction of the gas, and thus minimize the expulsion of gas, air and combustion products from the combustion chamber, and ignition means for igniting a mixture of gas and combustion air in the combustion chamber, the process comprising the steps:

a) injecting gas into the combustion chamber, b) causing combustion air to be drawn into the lower chamber and thence to pass upwardly into the combustion chamber to mix with the gas, c) igniting the mixture of gas and combustion air d) utilizing the vane means to impart the said cyclonic movement in one rotary direction to substantially all of the upwardly moving air, and e) utilizing the nozzle means to create in the injected gas the said cyclonic movement in the opposite rotary direction, resulting in a thorough mixing of the air with the gas, and the creation of a substantially stationary, stable, tight fireball in the vicinity of the nozzle means, thus ensuring that flame production will take place substantially entirely within the combustion chamber and that a visible flare will be avoided.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
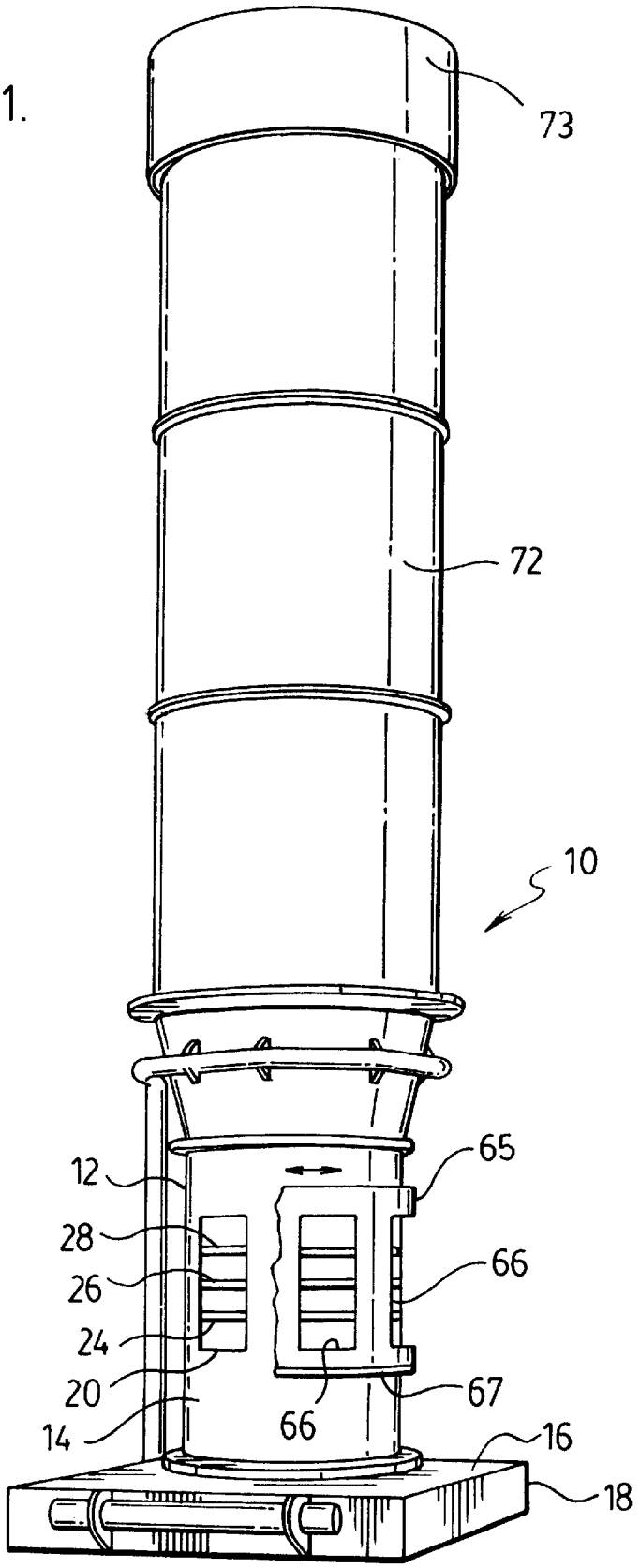
FIG. 1 is a perspective view of a gas incinerator in accordance with this invention.

Attention is directed first to FIG. 1, which shows a gas incinerator generally at 10. The incinerator includes a base portion 12 defined in pad by a cylindrical side wall 14 and closed at the bottom by a bottom wall provided by the upper surface 16 of a rectangular pedestal 18. The cylindrical side wall 14 has a plurality of rectangular apertures 20 spaced therearound.

The base portion defines a lower chamber 22, which receives air entering through the apertures 20.

Figure 2:
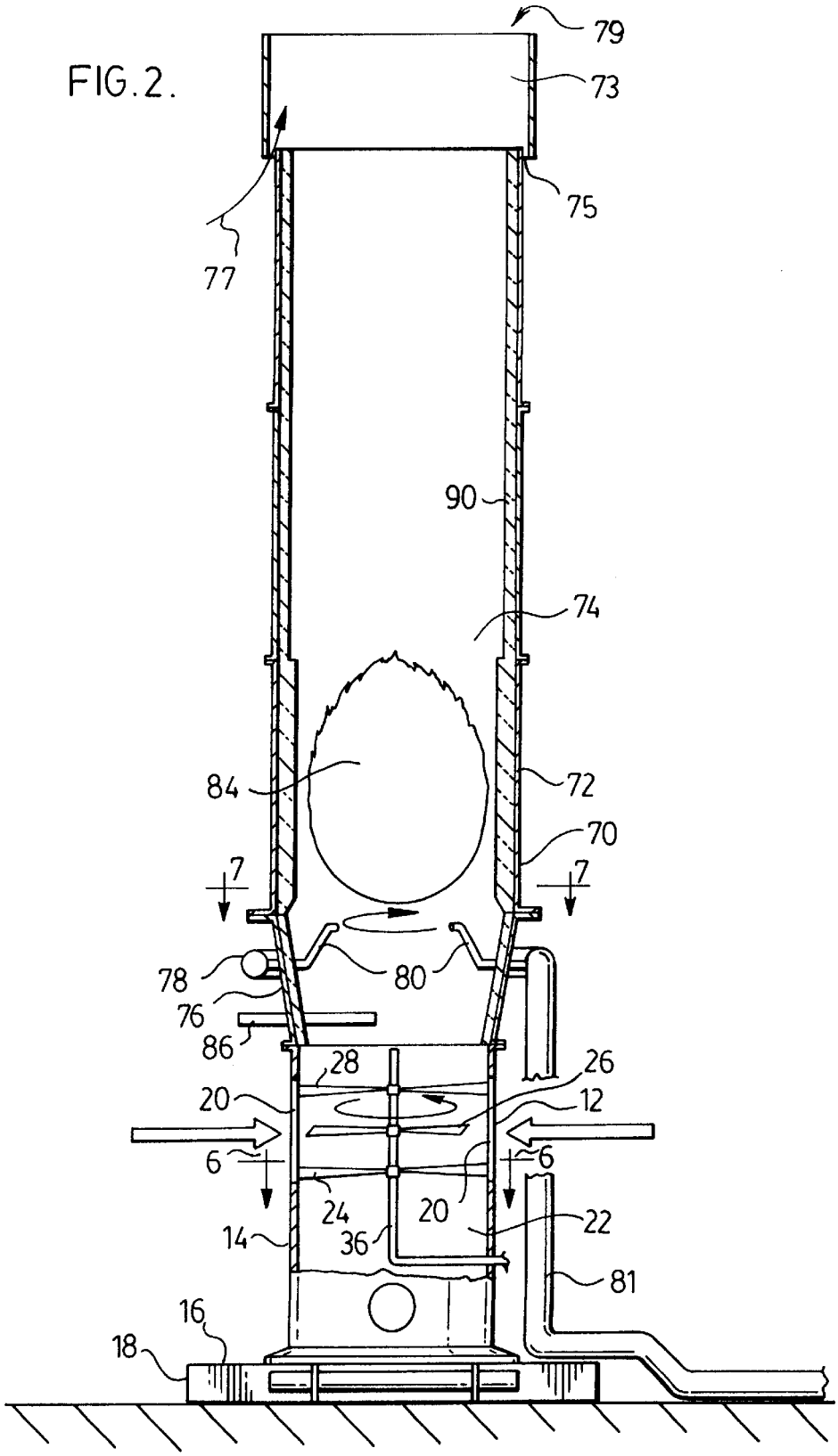
FIG. 2 is an axial section through the incinerator of FIG. 1, with a lower portion thereof seen in elevation.

Fixedly mounted within the lower chamber 22 are three sets of vanes, the sets being numbered 24, 26 and 28 (see FIG. 2).

Figure 3:
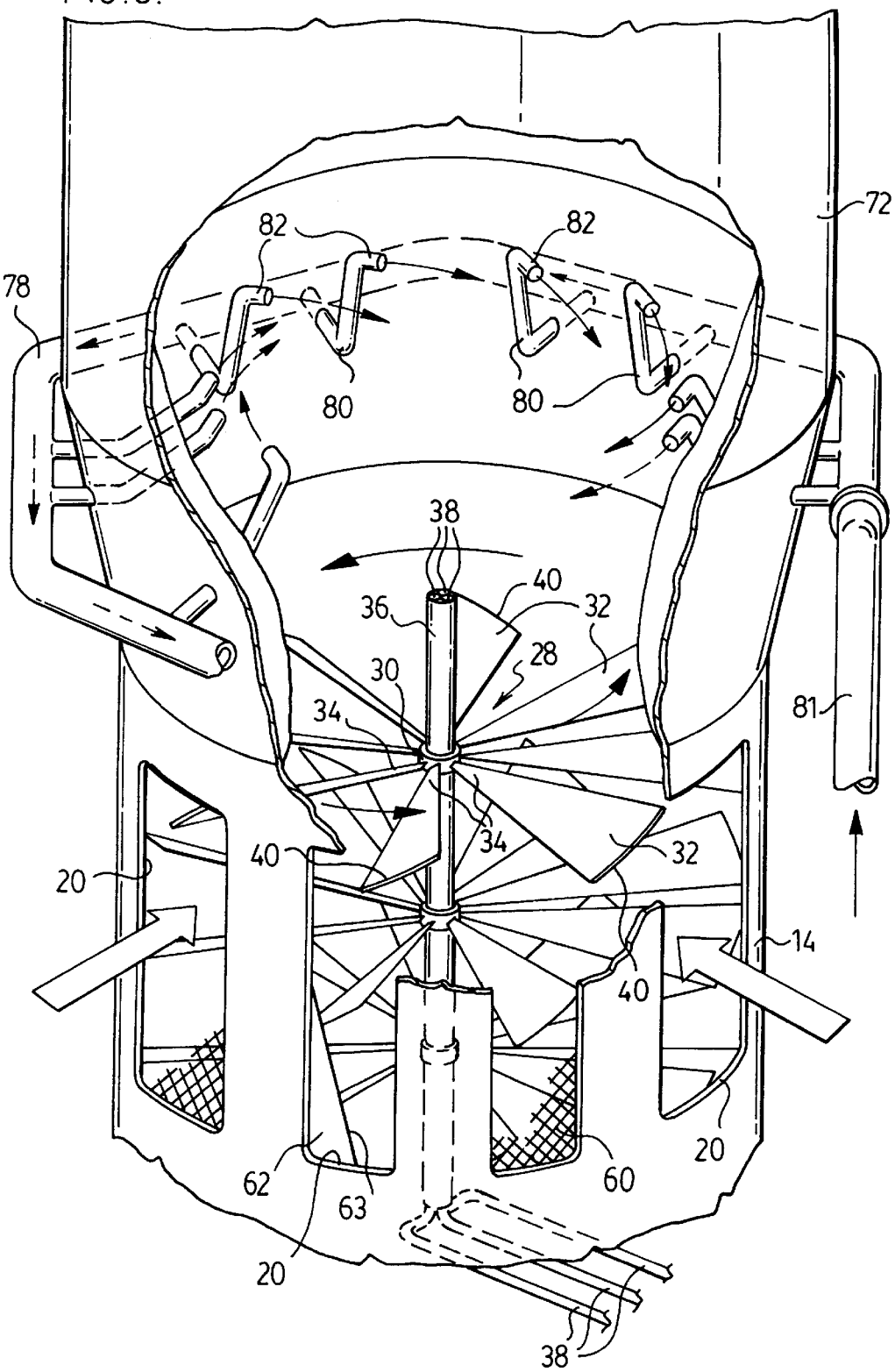
FIG. 3 is a partial perspective view, partly broken away, of the central portion of the incinerator seen in FIGS. 1 and 2.

For a more detailed explanation of the vane configuration, attention is directed to FIG. 3. in this figure, illustrating a portion of the cylindrical side wall 14, partly broken away, it will be seen that each set of vanes 24, 26 and 28 consists of a plurality of triangular vanes, each vane being similarly angled. In the embodiment illustrated, there are eight vanes per set, although it is also possible to provide more or less than eight vanes in a set.

The uppermost set 28 of vanes includes a central ring 30 to which all eight vanes 32 are anchored at an acute-angled vertex 34. The ring 30 is affixed to an upstanding axial member 36 which is in the form of a hollow pipe, along which three tubes 38 extend.

Still looking at FIG. 3, each vane 32 has a base edge 40 opposite the vertex 34, the base edge 40 having the same curvature as the cylindrical side wall 14 and being affixed thereto by welding, adhesion, or other suitable means, thereby securing the axial member 36 in place.

The sets 24 and 26 of vanes are both identical with the uppermost set 28, and thus do not require detailed description. The only difference between the various sets is the angulation at which they are put in place. Specifically, each pair of adjacent vanes of a given set are separated by a space which covers twice as many degrees as a single vane (taking into account that the vane is angled). The vanes of the different sets are disposed in such a way that the inter-vane space is "covered" by two vanes: one from each of the other two sets.

Figure 4:
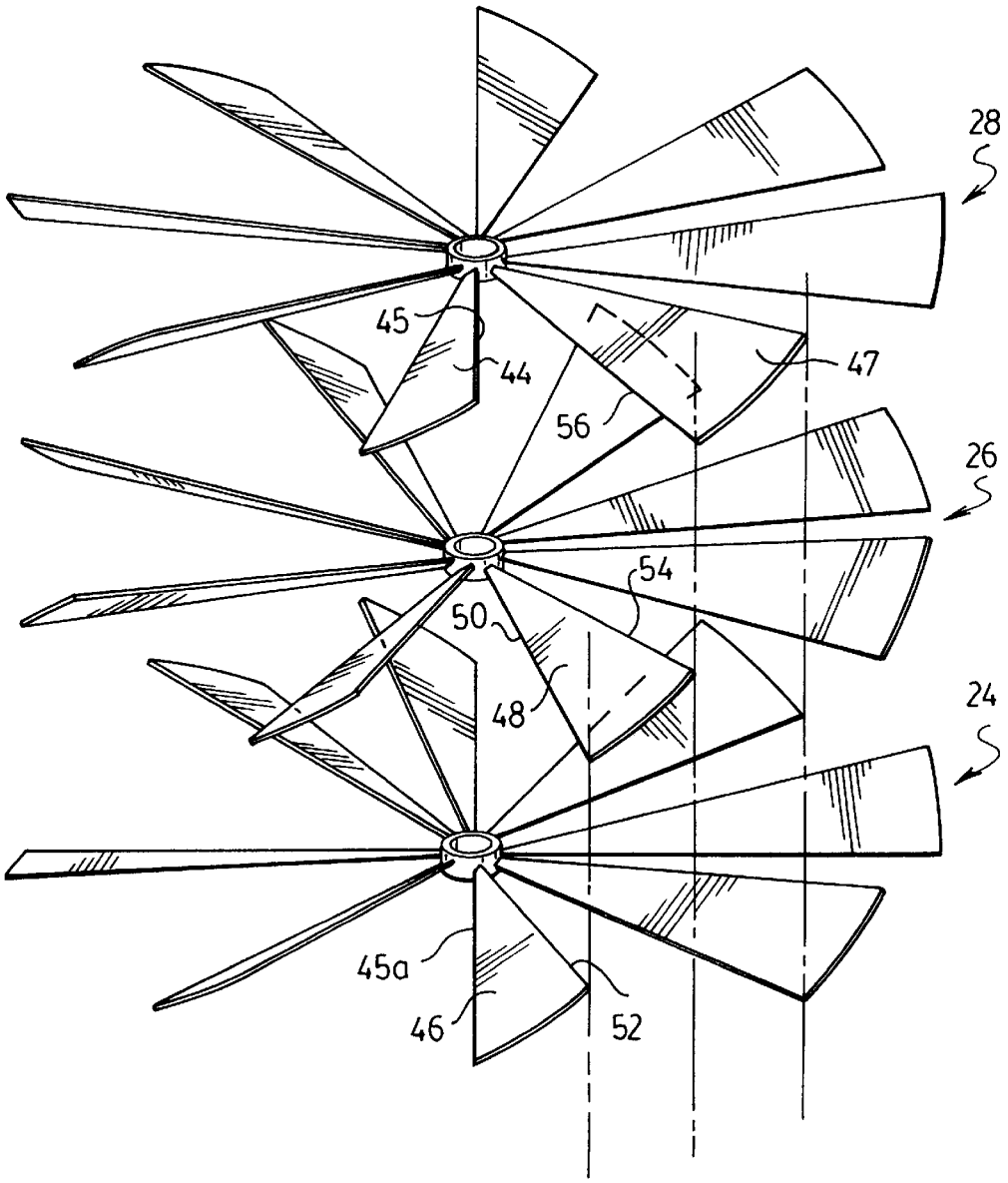
FIG. 4 is a somewhat schematic, perspective view of vanes which impart cyclonic movement to combustion air entering the device.

With reference to FIG. 4, it can be seen that the vane 44 of the top set 28 is angulated such that its rightward edge 45 lies perpendicularly above the leftward edge 45a of the vane 46 of the lowermost set 24. And to complete the coverage, the vane 48 of the middle set 26 has its left edge 50 perpendicularly above the right edge 52 of the vane 46, and has its right edge 54 perpendicularly below the leftward edge-56 of the vane 47 of the top set 28.

Returning to FIG. 3, it will be noted that the apertures 20 have a coarse screening 60 (only partially illustrated in only one of the apertures, in order to avoid cluttering the drawing). Also, there may be provided, for each aperture 20, a sliding cover 62 mounted in track-like guide means affixed inside the wall (not shown), allowing each cover to be slid across its aperture in order to close it entirely. The covers 62 may be manually or mechanically operated and may move in tandem or separately. As can be seen in FIG. 3, the illustrated cover 62 has a sloping edge 63, which allows the speed air entry to be more accurately adjusted.

Alternatively, as seen in FIG. 1, the degree of opening of each aperture 20 may be controlled by a cylindrical jacket 65 having removed portions 66 which have the same shape as the apertures 20, and which are distributed in such a way as to match the positioning of the apertures 20. Thus, the position of the jacket 65 in FIG. 1 is that which causes the openings 66 to coincide with the apertures 20, i.e., providing for maximum air entry. The jacket 65, which is mounted on a circular track 67 encircling the exterior of the sidewall 14, can be rotated about the axis of the sidewall 14 such that there is a partial to total occlusion of the apertures 20 by the portions of the jacket 65 which lie between the openings 66. The jacket may be moved manually, or may be operated mechanically, for example, utilizing a rack and pinion construction.

At the top of the cylindrical wall 72 is a wind shroud 73 of conventional construction and operation. As can be seen at the top in FIG. 2, the wind shroud 73 is mounted such as to leave an annular opening 75 through which air can enter the wind shroud 73 (as indicated by arrow 77).

Attention is again directed to FIGS. 1 and 2, which illustrate an upper portion 70 with a cylindrical upper wall 72 defining a combustion chamber 74 which is in direct communication with the lower chamber 22 through a frusto-conical throat 76, and has an upper opening 79. Encircling the throat 76 is a manifold 78 from which a plurality of delivery pipes 80 extend inwardly through openings in the throat, as best seen in FIG. 3. Each delivery pipe 80 has a nozzle 82 at its downstream end, and the nozzles 82 are all angulated with respect to a radial line from an imaginary axis of the wall 72, so as to impart, to a gaseous material fed thereto from the manifold 78, a cyclonic movement in the rotary direction which would appear to be clockwise when looking down from above. A feed pipe 81 supplies gas to the manifold 78.

By contrast, the vanes 32 of the sets 24, 26 and 28 are all angulated in such a way as to give a counter-clockwise rotation to air entering the lower chamber 22 through the apertures 20. Thus, air rising up through the vanes will take on a counter-clockwise rotation, whereas the waste gas injected through the nozzles 82 will rotate in a clockwise direction (both as seen from above). The clash of these opposed rotary directions creates turbulence which promotes excellent mixing of the waste gas with the air. The result of this turbulence is to create a tight, stable fireball 84 (see FIG. 2) located closely above the position of the pipes 80, and well down from the top of the wall 72, where the combustion chamber 74 opens upwardly, This will ensure complete combustion within the chamber 74, and will prevent visible flames from exiting upwardly from the combustion chamber 74.

A further configuration which promotes stabilization of the fireball 84 and prevents the escape of visible flame has to do with the direction in which the nozzles 82 are aimed, in the embodiment illustrated, the injection direction of all of waste gas entering through the nozzles 82 is substantially parallel to a hypothetical plane transverse to the axis of the wall 72 (and thus of the axis of the cyclonic movement of air), thus avoiding an axial component in the injection direction of the gas, and thus minimizing the expulsion of gas, air and combustion products from the combustion chamber. Of course, these products do exit from the combustion chamber, but such escape is not accelerated as it would be. if the nozzles 82 were aimed partly in the upward direction.

Ignition means 86 (FIG. 2) is provided for igniting the mixture of gas and combustion air in the combustion chamber 74. Once combustion has been initiated in this way, combustion air will be drawn into the lower chamber 22 through the apertures 20, and will be further drawn upwardly into the combustion chamber 74 to mix with the waste gas injected through the nozzles 82. The ignition probe 86 is shown only schematically at 86, because its structure will be familiar to those skilled in the art. Optionally, a solar panelled battery system or a converter connected to a power grid system provides electrical energy which creates ignition sparks on a continuous basis. The incinerator is thus provided with a continuous flame pilot system.

Once the burning of the gas has been initiated, it will be self-sustaining due to the force of convection. The hot products of combustion rising upwardly from the fireball 84 will cause a partial vacuum in the lower chamber 22, which will draw further air into the chamber from the ambience, whereupon this air will rise past the vanes, and in so doing receive a cyclonic spin in the direction opposite the spin given to the waste gases by the nozzles 82.

Attention is directed to FIG. 2, which shows that the transitional portion 76 and the wall 72 of the upper portion are lined with fire-resistant insulation material 90, which may be a ceramic or refractory material, firebrick, or any other suitable material adapted to withstand high temperatures for extended periods. In particular, the insulative layer 90 is somewhat thicker toward the bottom of the cylindrical wall 72, i.e. directly adjacent the fireball 84.

Figure 5:
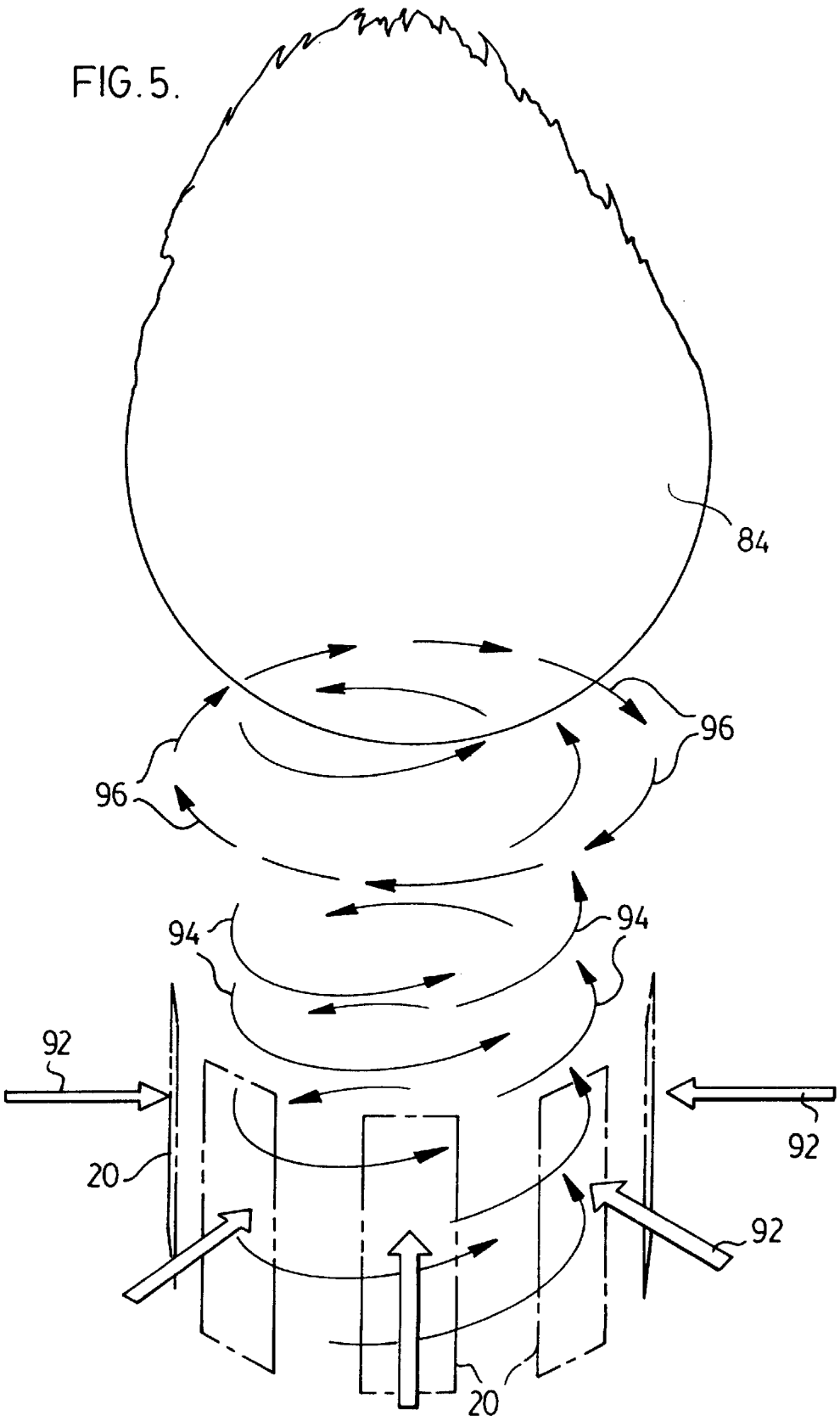
FIG. 5 is a schematic representation of the cyclonic movement of combustion air in relation to the position of the fireball.
Figure 6:
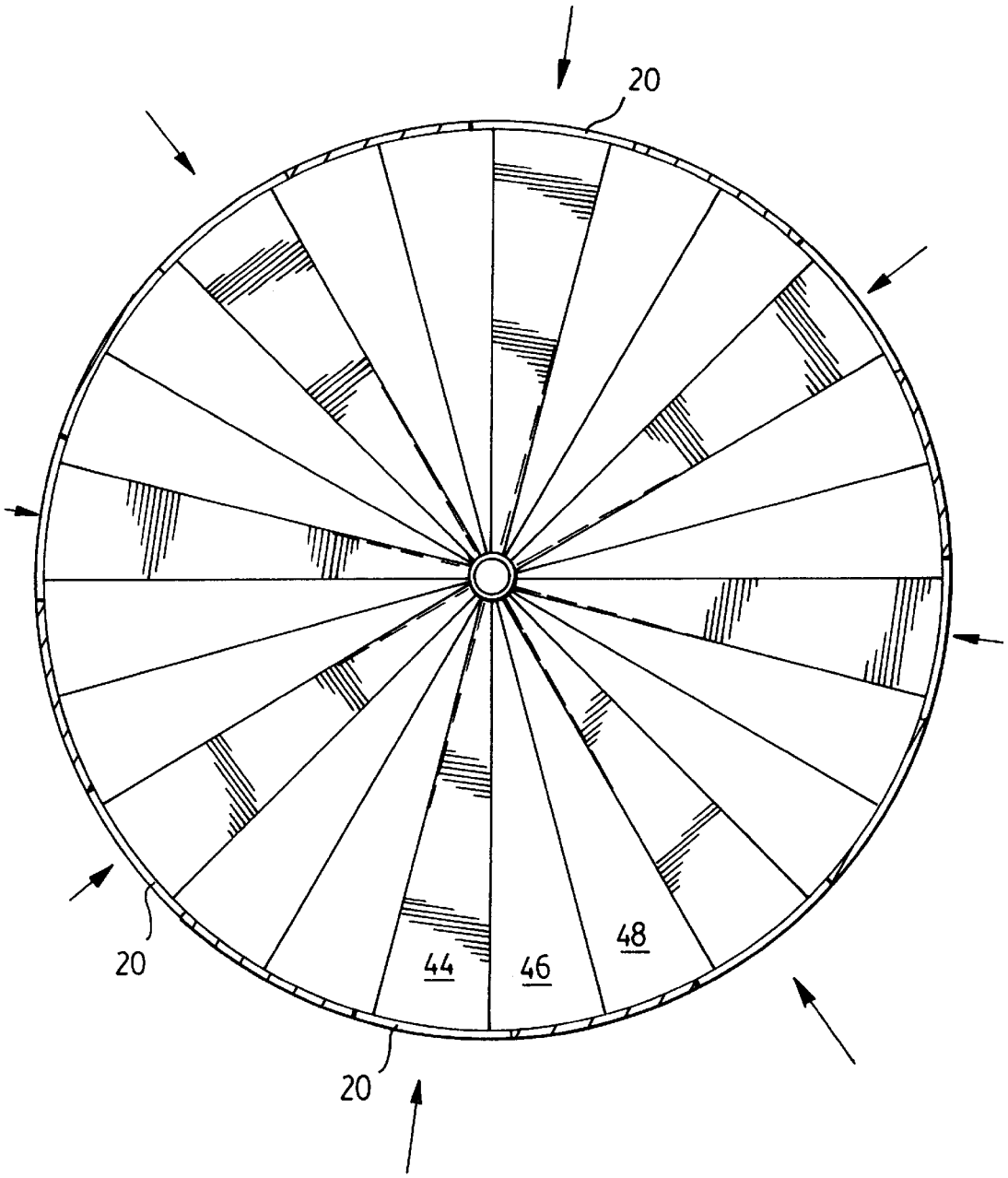
FIG. 6 is a transverse sectional view through the incinerator of FIG. 2 taken along the line 6—6 in FIG. 2.
Figure 7:
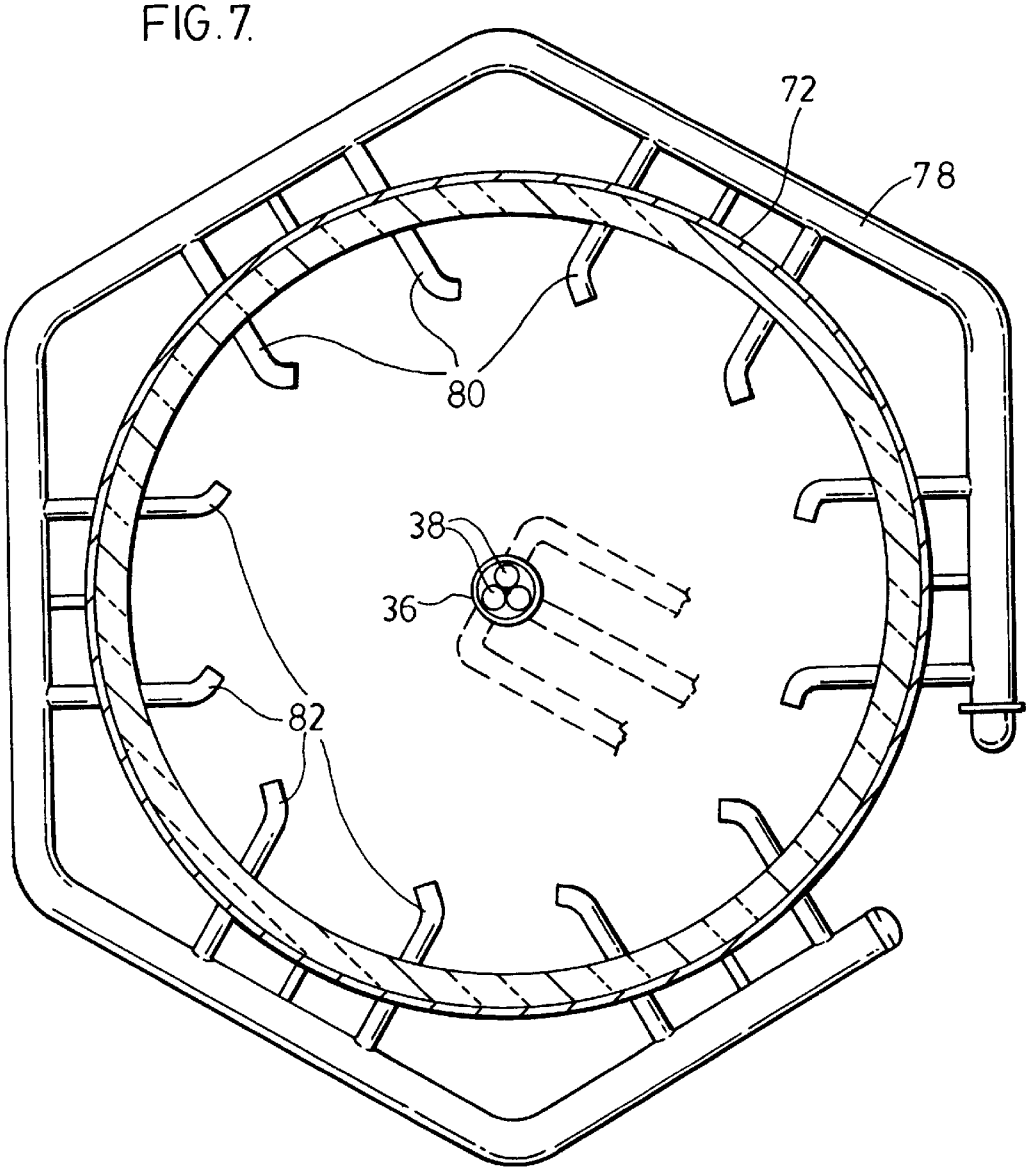
FIG. 7 is a transverse sectional view looking down on the fuel-injection nozzles, taken at the line 7—7 in FIG. 2.

Attention is now directed to FIG. 5, which schematically shows the positions of the apertures 20, and outside or ambient air entering into the lower chamber (22) in the direction of the arrows 92. Inside the lower chamber (22) the arrows 94 indicate the rotary direction of the air as it passes upwardly through the vanes, this direction being counter-clockwise as seen from above. Just below the fireball 84, the arrows 96 represent the rotary direction of the waste gas being incinerated, and it will be noted that this direction is opposite that of the combustion air, i.e. clockwise as seen from above.

It will thus be clear that there is provided a gas incinerator which has no moving parts, while at the same time being self-aspirating (drawing in combustion air which passes upwardly through the vanes). As a result, a long, maintenance-free service life can be expected.

It has been found that the incenerator structure described herein, due to its abilities to establish and maintain a tight, stable fireball 84, has a substantial throughput of combustion air (automatically self-aspirated) which is of a speed so as to carry any contained sulfur dioxide high enough to distribute the sulfur dioxide broadly enough to fall easily within allowable government limits. This measurement is referred to as the ground dispersion of sulfur dioxide.

While one embodiment of the present invention has been illustrated in the accompanying drawings and described hereinabove, it will be evident to those skilled in the art that changes and modifications may be made therein without departing from the essence of the invention, as set forth in the appended claims.

What is claimed is:

1. A gas incinerator comprising:

a base portion having lower wall means defining a lower chamber, aperture means in the lower wall means, through which combustion air can flow from outside the incinerator into the lower chamber, an upper portion having upper wall means defining a combustion chamber in communication with said lower chamber, the combustion chamber having, remote from the lower chamber, an opening through which products of combustion can exit from the combustion chamber, vane means within said lower chamber, the vane means being configured so as to impart a cyclonic movement in one rotary direction to air moving upwardly from the lower chamber to the combustion chamber, nozzle means for injecting gas into the combustion chamber in such a direction as to impart, to the injected gas, a cyclonic movement in the rotary direction opposite to said one rotary direction, while avoiding promotion of gas movement out through said opening, and ignition means for igniting a mixture of gas and combustion air in the combustion chamber, thereby causing combustion air to be drawn into the lower chamber and thence to pass upwardly into the combustion chamber to mix with the gas, the vane means imparting said cyclonic movement in one rotary direction to the upwardly moving air while the nozzle means creates in the injected gas the said cyclonic movement in the opposite rotary direction, resulting in a thorough mixing of the air with the gas.

2. The incinerator claimed in claim 1, in which the vane means extends substantially from the center of the lower chamber to said lower wall means, he incinerator further comprising damper means adapted to control the throughout of combustion air.

3. The incinerator claimed in claim 1, further comprising a damper means mounted on said base portion and adapted to occlude said aperture means in the lower wall means, to a desired degree.

4. The incinerator claimed in claim 1, in which the vane means comprises a plurality of oblique, generally triangular vanes each having a base mounted on and secured obliquely to said lower wall means at the level of the aperture means, and each having opposite the base a vertex secured to and supported by an upstanding axial member, whereby the vanes span across the full extent of the lower chamber.

5. The incinerator claimed in claim 1, in which the nozzle means comprises a manifold at least partly encircling said upper portion, the manifold having a plurality of pipes extending therefrom, each extending through said upper wall means and terminating in a nozzle which injects gas in a tangential direction.

6. The incinerator claimed in claim 1, in which both the lower wall means and the upper wall means are substantially cylindrical, the diameter of the upper wall means being greater than that of the lower wall means, the incinerator further comprising a frusto-conical transition portion between the upper and lower wall means.

7. The incinerator claimed in claim 4, in which said axial member is an internal riser pipe with an open inner end, substantially coaxial with said lower wall means, the riser pipe, in addition to supporting the vanes, serving to deliver relatively low pressure gas to the combustion chamber, in order to provide for the combustion of gases at different pressures.

8. The incinerator claimed in claim 1, in which at least the portion of the upper wall means directly exposed to burning gases is protected by a lining of a material selected from the group consisting of ceramic, fire-brick.

9. A process for incinerating gas, utilizing a gas incinerator which includes: a base portion having lower wall means defining a lower chamber, aperture means in the lower wall means, through which combustion air can flow from outside the incinerator into the lower chamber; an upper portion having upper wall means defining a combustion chamber in communication with said lower chamber, the combustion chamber having, remote from the lower chamber, an opening through which products of combustion can exit from the combustion chamber; vane means within said lower chamber, the vane means being configured so as to impart a cyclonic movement in one rotary direction to substantially all of the air moving upwardly within the lower chamber; nozzle means for injecting gas into the combustion chamber in such a direction as to impart, to the injected gas, a cyclonic movement in the rotary direction opposite to said one rotary direction, while avoiding the promotion gas movement out through said opening; and ignition means for igniting a mixture of gas and combustion air in the combustion chamber, the process comprising the steps:

a) injecting gas into the combustion chamber, b) causing combustion air to be drawn into the lower chamber and thence to pass upwardly into the combustion chamber to mix with the gas, c) igniting the mixture of gas and combustion air d) utilizing the vane means to impart the said cyclonic movement in one rotary direction to substantially all of the upwardly moving air, and e) utilizing the nozzle means to create in the injected gas the said cyclonic movement in the opposite rotary direction, resulting in a thorough mixing of the air with the gas, and the creation of a substantially stationary, stable, tight fireball in the vicinity of the nozzle means, thus ensuring that flame production will take place substantially entirely within the combustion chamber and that a visible flare will be avoided.

10. The process claimed in claim 9, in which the vane means extends substantially from the center of the lower chamber to said lower wall means, said process further comprising utilizing a manually operable damper means to control the throughput of combustion air.

11. The process claimed in claim 9, further comprising utilizing a manually operable damper means mounted in said base portion to occlude said aperture means in the lower wall means to a desired degree.

12. The process claimed in claim 9, in which the vane means comprises a plurality of oblique, generally triangular vanes each having a base mounted on and secured obliquely to said lower wall means at the level of the aperture means, and each having opposite the base a vertex secured to and supported by an upstanding axial pipe member; in which the nozzle means comprises a manifold at least partly encircling said upper portion, the manifold having a plurality of pipes extending therefrom, each extending through said upper wall means and terminating in a nozzle which injects gas in a tangential direction lying substantially entirely within a hypothetical plane transverse to said axial member; in which both the lower wall means and the upper wall means are substantially cylindrical, the diameter of the upper wall means being greater than that of the lower wall means, the incinerator further comprising a frusto-conical transition portion between the upper and lower wall means; in which said axial pipe member is an internal riser pipe with an open inner end, substantially coaxial with said lower wall means, the axial pipe member, in addition to supporting the vanes, serving to deliver relatively low-pressure gas to the combustion chamber, to provide for the incineration of low-pressure gas from a different source.

13. The process claimed in claim 9, in which at least the portion of the upper wall means directly exposed to burning gases is protected by a lining of a material selected from the group consisting of: ceramic, fire brick.

14. A gas incinerator comprising:

a base portion having lower wall means defining a lower chamber, aperture means in the lower wall means, through which combustion air can flow from outside the incinerator into the lower chamber, an upper portion having upper wall means defining a combustion chamber in communication with said lower chamber, the combustion chamber having, remote from the lower chamber, an opening through which products of combustion can exit from the combustion chamber, vane means within said lower chamber, the vane means being configured so as to impart a cyclonic movement in one rotary direction to air moving upwardly from the lower chamber to the combustion chamber, nozzle means for injecting gas into the combustion chamber in such a direction as to impart, to the injected gas, a cyclonic movement in the rotary direction opposite to said one rotary direction, the injection direction of substantially all of the gas being substantially parallel with a hypothetical plane transverse to the axis of the said cyclonic movement of air, thereby to avoid an axial component in the injection direction of the gas, and thus minimize the expulsion of gas, air and combustion products from the combustion chamber, and ignition means for igniting a mixture of gas and combustion air in the combustion chamber, thereby causing combustion air to be drawn into the lower chamber and thence to pass upwardly into the combustion chamber to mix with the gas, the vane means imparting said cyclonic movement in one rotary direction to the upwardly moving air while the nozzle means creates in the injected gas the said cyclonic movement in the opposite rotary direction, resulting in a thorough mixing of the air with the gas.

15. A process for incinerating a gas, utilizing a gas incinerator which includes: a base portion having lower wall means defining a lower chamber; aperture means in the lower wall means, through which combustion air can flow from outside the incinerator into the lower chamber; an upper portion having upper wall means defining a combustion chamber in communication with said lower chamber, the combustion chamber having, remote from the lower chamber, an opening through which products of combustion can exit from the combustion chamber; vane means within said lower chamber, the vane means being configured so as to impart a cyclonic movement in one rotary direction to substantially all of the air moving upwardly within the lower chamber; nozzle means for injecting gas into the combustion chamber in such a direction as to impart, to the injected gas, a cyclonic movement in the rotary direction opposite to said one direction, the injection direction of substantially all of the gas being substantially parallel with a hypothetical plane transverse to the axis of the said cyclonic movement of air, thereby substantially to avoid an axial component in the injection direction of the gas, and thus minimize the expulsion of gas, air and combustion products from the combustion chamber; and ignition means for igniting a mixture of gas and combustion air in the combustion chamber, the process comprising the steps:

a) injecting gas into the combustion chamber, b) causing combustion air to be drawn into the lower chamber and thence to pass upwardly into the combustion chamber to mix with the gas, c) igniting the mixture of gas and combustion air d) utilizing the vane means to impart said cyclonic movement in one rotary direction to substantially all of the upwardly moving air, and e) utilizing the nozzle means to create in the injected gas said cyclonic movement in the opposite rotary direction, resulting in a thorough mixing of the air with the gas, and the creation of a substantially stationary, stable, tight fireball in the vicinity of the nozzle means, thus ensuring that flame production will take place substantially entirely within the combustion chamber and that a visible flare will be avoided.

* * * * *